US005893223A

United States Patent [19]

Glass

[11] Patent Number: 5,893,223

[45] Date of Patent: *Apr. 13, 1999

[54] WEIGHTED FOOTWEAR GARMENT FOR EXERCISE, TRAINING AND/OR THERAPY

[76] Inventor: Alvin Glass, 151 Tamalpais Ave., Mill Valley, Calif. 94941

[ * ] Notice: This patent is subject to a terminal disclaimer.

[21] Appl. No.: 08/978,410

[22] Filed: Nov. 25, 1997

Related U.S. Application Data

[63] Continuation-in-part of application No. 08/699,523, Aug. 21, 1996, Pat. No. 5,728,032.

[51] Int. Cl.[6] ..... A43B 5/18; A43B 3/20

[52] U.S. Cl. ..... 36/132; 36/136; 36/7.2; 482/105; 482/74; 482/79

[58] Field of Search ..... 36/132, 136, 7.2, 36/7.3, 7.4, 72 R, 97; 482/105, 74, 79

[56] References Cited

U.S. PATENT DOCUMENTS

| | | |
|---|---|---|
| 757,983 | 4/1904 | Vaile . |
| 900,499 | 10/1908 | Eckhard, Jr. . |
| 1,539,762 | 5/1925 | Mussabini . |
| 1,664,115 | 3/1928 | Kenyon, Jr. . |
| 3,114,982 | 12/1963 | McGowan . |
| 3,306,610 | 2/1967 | Biggs, Jr. et al. . |
| 3,427,020 | 2/1969 | Montour et al. . |
| 4,120,103 | 10/1978 | Colby . |
| 4,458,432 | 7/1984 | Stempski . |
| 4,777,743 | 10/1988 | Roehrig, Jr. . |
| 4,969,277 | 11/1990 | Williams . |
| 5,514,056 | 5/1996 | Ronca et al. . |
| 5,728,032 | 3/1998 | Glass . |

*Primary Examiner*—Ted Kavanaugh

[57] ABSTRACT

A readily removable two piece stretch fabric garment (3) with four pockets (4,5,6,7) for containing weights (4*a*, 5*a*, 6*a* 7*a*) is attached to the users athletic or conventional shoe (2) for the purpose of exercise, training and/or physical therapy. The weights are contoured to match the shape of that portion of the shoe which they overly and they are secured in their respective pockets by releasable Velcro (R) closures. A durable rubber or vinyl sole (8) connected to the toe portion of the footwear garment grips the toe segment of the shoe and forms a partial under surface for the garment to the shoe.

10 Claims, 3 Drawing Sheets

WEIGHTED FOOTWEAR GARMENT FOR EXERCISE, TRAINING AND/OR THERAPY

CROSS REFERENCE TO RELATED APPLICATIONS

This application is a continuation in part for patent application Ser. No. 08/699,523 filed Aug. 21,1996 now U.S. Pat. No. 5,728,032.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention relates to a removable garment that contains weights which fit around an athletic or conventional shoe and allows for total unrestricted mobility for use in exercise, training and/or therapy.

There are a number of weight devices for exercising that can be connected to a leg or attached to a shoe or foot and used principally for the purpose of improving strength in this are ankle cuff weights which are used by some runners and power walkers and do allow for unrestricted mobility of the limb. However, they usually cannot be sufficiently secured to the ankle to avoid some movement while running, jumping or walking. The movement of the cuff weights while engaged in such activities often results in skin irritations as well as other potential injuries. U.S. Pat. No. 5,514,056 to Ronca addresses this issue by firmly securing a weight apparatus to the lower leg proximal to the ankle. The fact that both of these weight devices are located at the ankle or proximal to it precludes their capability of strengthening the lower leg muscles whose tendons insert on the foot and/or toes. In addition both of these devices are likely to be perceived as unnatural encumbrances around the lower limbs of their users.

In regard to prior art there are four weight devices that can be attached to a shoe and one weighted shoe that allows for unrestricted mobility of the foot and limb while performing aerobic exercises including activities such as running and/or walking. They are U.S. Pat. No. 3,114,982 to McGowan, G.B. patent 2139103 to Rogers, U.S. Pat. No. 4,458,432 to Stempski, U.S. Pat. No. 757,983 to Vaile and FR patent 2,535,211 to Deschamps.

U.S. Pat. No. 3,114,982 allows for weight adjustments and easy attachment on and off a shoe. One disadvantage of this device is that it does necessitate alteration of the shoe by requiring snaps to be permanently attached to the shoe so that weights can be secured to it. Another disadvantage is that the weights with this device are confined to just the lateral side of the shoe. This results in an imbalance of the weight distribution requiring excess effort on the part of the peroneus longus and brevis muscles which turn the foot out. It offers no resistance to the tibialis posterior which turns the foot in and little resistance to the tibialis anterior which raises the foot up nor does it provide resistance to the extensor digitorum longus, brevis and extensor hallicus longus all of which elevate the toes. This imbalance in strengthening primarily the peroneus longus and brevis muscles that turn the foot out could contribute to the development of a flat foot.

Though, G.B. patent 2,139,103 obviates this imbalance problem it limits the weight distribution to just two locations, one on the lateral side of the shoe and the other on the medial side. Rather than snaps, the weights with this device are secured to the shoe with laces and a strap. In addition to the disadvantage of having only two sites for weight distribution there is another disadvantage of this device that relates to the use of laces. In order to secure this device to a shoe and then remove it from the shoe a rather time consuming and tedious lacing and unlacing process is necessary since both the weighted device as well as the shoe have to be laced and unlaced together.

U.S. Pat. No. 4,458,432 does accommodate weights at the toe, heel and sides but it requires that the pockets be permanently attached to a runners athletic shoe. Since the toe pocket is confined to just the outer edges of the toe section of the shoe the amount of weight that it can hold is severely restricted. The total weight that can be added to this runners shoe is limited to only 10 to 12 ounces.

U.S. Pat. No. 757,983 reveals a weighted overshoe (FIG. 4) comprising a Cap F which includes sole portion and a strap f which fits around the heel. Here only a single weight over the toe can be accommodated and a metallic cap precludes its use with present day athletic shoes containing cleats or spikes.

Fr patent 2,535,211 is a weighted overshoe that can be attached to a foot or shoe. The weights are cylindrical in shape and are confined to the medial and lateral sides and lie horizontal while the remainder lie vertical and are located over the medial and lateral sides of the ankle. The former would appear to restrict movement of the ankle invertors and evertors while the overshoe itself may limit complete dorsiflexion of the foot. Though this device may be compatible with running and walking it appears to be more suitable for static exercise strengthening of the muscles proximal to the lower leg such as the quadriceps and hamstrings.

It is a recognized fact that the more distal from the joint center that a weight is placed the greater the work load or resistance will be in moving the respective limb segment through its range. Weights located more distal on a limb, i.e. the foot, than weights of equal density and mass located more proximal on the lower leg or thigh will necessitate greater muscular effort and in so doing enhance the users strengthening and conditioning regimen. Consequently, a need exists for taking advantage of this principal in which weights can be secured to the most distal parts of an appendage such as the foot and particularly the toe portion of the foot without restricting mobility of any of the joints of the limb and especially the toe joints. U.S. Pat. No. 4,458,432 does partially meet this need but at the expense of permanently altering a runners athletic shoe. It would be advantageous to have a device with a toe weight that covers most if not all of the toe area extending from the distal toe tip proximal to the metatarsal phalangeal joint line and at the same time accommodate weights varying from several ounces to several pounds or greater without altering the integrity of the shoe to which it is attached. In addition, a device that is easy to make and very inexpensive yet interchangeable with a variety of athletic shoes such as track, football, baseball, basketball etc. would certainly be cost effective for those engaged in multiple athletic pursuits.

The present invention fulfills the needs present in the prior art by providing a unique weight device as defined in the following description and claims.

BRIEF SUMMARY OF THE INVENTION

The present invention is a simple slip-on strap-on multiple weight attachment device that requires no alteration of the host shoe and provides an evenly balanced and a non-encumbrance form of resistance to the user. It is comprised of a two piece garment, made of stretch fabric, that encircles the users shoe and contains a series of compartments to accommodate or hold their respective weights. The garment can be secured to the shoe by pulling it over the edge of the toe section of the shoe and stretching it around the heel portion of the shoe or by connecting the toe section to the heel and sides section through attachments such as buckles and straps on each side of the garment, or by laces, buttons, snaps, zippers, hook and eye, and/or overlapping VELCRO. There are four compartments which are pockets that are created by stitching two layers of the garment material together. They include a toe, heel and two side pockets, medial and lateral, all of which have releasable adhesive fabric VELCRO closures to help retain the weights within them. A sole made of vinyl or rubber which can be easily modified to accommodate cleats or spikes is stitched to the under surface of the distal toe portion of the garment providing additional gripping across the toe section of the shoe. The toe, sides and heel weights are all contoured to assume the shape of the segment of the shoe to which they are applied. VELCRO is a trademark for a material made with a surface of tiny hooks and a complementary surface of adhesive pile which can be pressed together and pulled apart for easy fastening and unfastening.

Objects and advantages of the present invention are:

(a) to provide a readily removable and easy to put on weighted footwear garment that can be used in a wide variety of athletic shoes for the purpose of exercise, training or therapy and does not require any form of alteration of the host shoe.

(b) to provide VELCRO (R) closures on each of the pockets to allow for exchange of varying density weights as needed and to secure the weights to the footwear garment.

(c) to provide contoured weights so designed as to not interfere with movement particularly at the metatarsal phalangeal joint line as well as at the ankle joint.

(d) to provide a more physiologically balanced resistance for the muscles of the lower extremity, particularly for those that control the foot, such as the dorsi and plantar flexors as well as the invertors and evertors plus toe extensors.

(e) to provide a readily removable and easy to put on weighted footwear device for the purpose of trying to improve stability in those patients with balance and gait disturbances due to certain neurological disorders.

(f) to provide a means of improved conditioning, strengthening and weight control.

(g) to provide a means of achieving optimal peak performance through a progressive weight resistance training program utilizing the weighted footwear garment.

This invention, the two piece stretch fabric garment allows for a more secure fit and a wider array of fit than the one piece stretch fabric garment. It also provides physiological advantages over other weight devices in a large number of exercises and training activities as well as certain therapeutic treatment regimens. The weighted foot-wear garment enables one to expend increased energy and hence burn more calories resulting in increased weight reduction in a variety of aerobic exercises and/or physical activities some of which include running, power walking and treadmill use. The increase in energy expenditure can be attributed to an increased work load resulting from a greater moment of force that occurs with the toe weight placement being more distal to the ankle fulcrum with the footwear garment as opposed to other weight devices being more proximal with their weights on the sides of the shoe or around the ankle or even located higher on the limb.

Additional objects and advantages of this simple to use and inexpensive to manufacture weighted footwear garment will be made apparent from the ensuing description and drawings.

BRIEF DESCRIPTION OF THE VIEWS OF THE DRAWING

In the drawings, the weights have the same identical number as their corresponding compartment or pocket but are identified individually by alphabetic suffixes.

REFERENCE NUMERALS IN DRAWINGS

Figure 1:
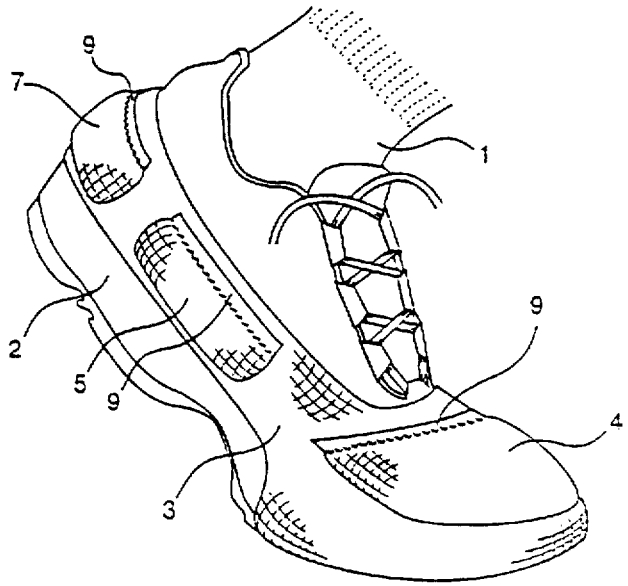
FIG. 1 is a side view that shows the lower leg and ankle in an athletic shoe that has the weighted footwear garment attached to it.

1. Lower leg and ankle
2. Athletic shoe
3. Footwear garment
3*a*. Toe section of footwear garment
3*b*. Heel and side section of footwear garment
4. Toe pocket
4*a*. Right toe weight
4*b*. Left toe weight
5. Lateral side pocket
5*a*. Lateral side weight
6. Medial side pocket
6*a*. Medial side weight
7. Heel pocket
7*a*. Heel weight
8. Rubber sole
9. Pocket closure
10. Buckle
11. Strap

DETAILED DESCRIPTION OF THE INVENTION

Figure 2:
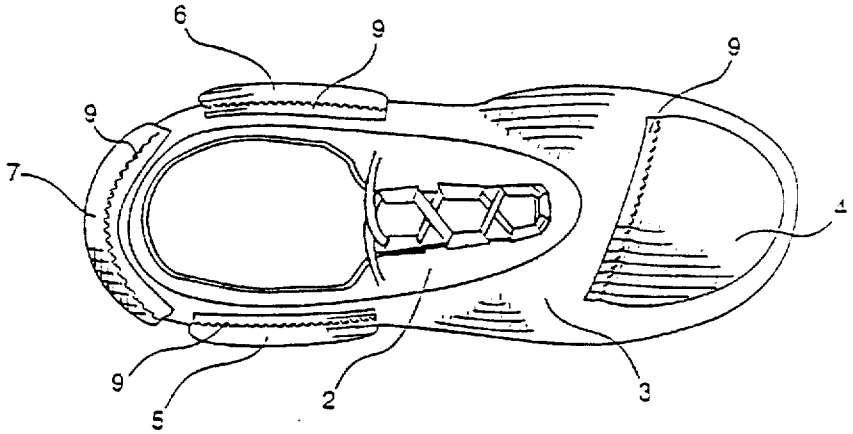
FIG. 2 is an overhead view of the footwear garment that shows the four pockets incorporated into it. The hash marks signify closures for each of the pockets.
Figure 6:
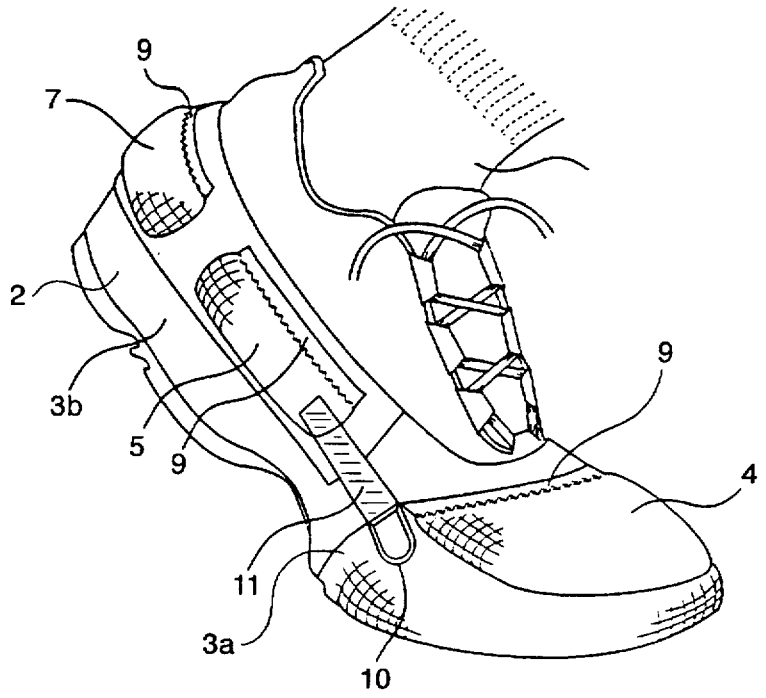
FIG. 6 is a side view of the footwear garment divided into two sections and secured to the shoe through a buckle and strap connection.

Referring to the drawings wherein a preferred embodiment of the invention is illustrated in FIG. 1. The lower leg and ankle 1 with the foot in an athletic shoe 2 is depicted in an active pre-toe off walking or running position. FIG. 1 and 2 reveal the foot-wear garment 3 with pockets 4, 5, 6 and 7. The footwear garment is made of a stretch fabric giving it a definite elastic quality. This elasticity contributes to a tight fit as the garment is stretched taut across the toes and around the heel of the shoe. The length of the garment need only be slightly less than the length of the shoe to assure an adequate fit. FIG. 6 illustrates a preferred embodiment of the two piece garment 3a and 3b attached to the shoe 2 by connecting and pulling taut with VELCRO straps 11 on the heel and side section 3b through buckles 10 on each side of the toe section 3a. Selection of garment sizes from small, medium, large and extra-large suffice to match most if not all available shoe sizes. The pockets 4, 5, 6, and 7 are sewn onto the garment and are made of the same stretch fabric that make up the footwear garment.

Figure 4:
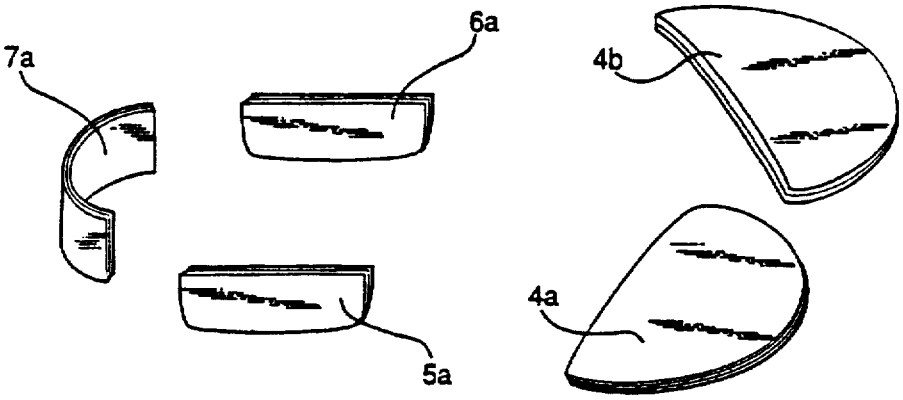
FIG. 4 shows the toe weight, medial and lateral side weights plus the heel weight that are placed in the pockets of the footwear garment.
Figure 5:
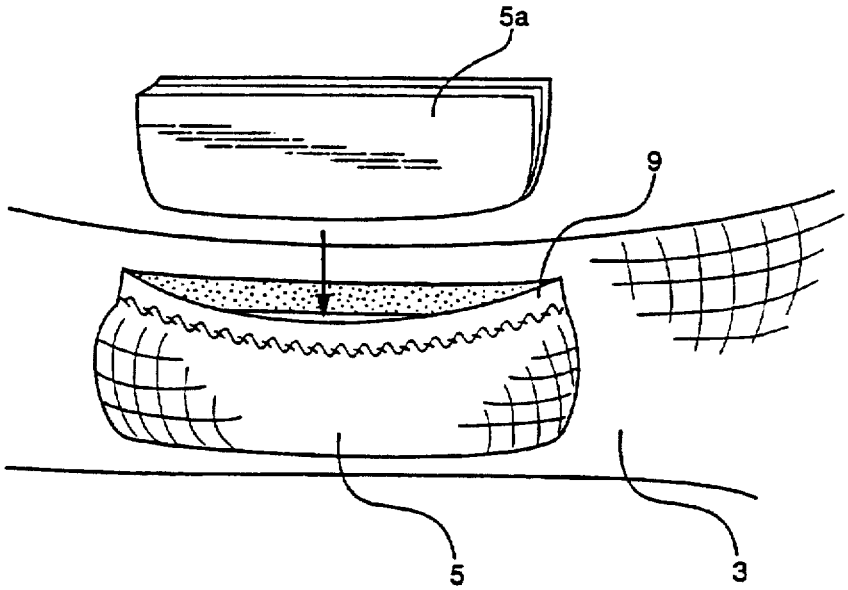
FIG. 5 shows a side pocket opened in order to receive its respective side weight.

The hash marks 9 appearing at the top of the pockets 4, 5, 6 and 7 in FIGS. 1, 2 and 5 represent their closures. The closures consist of two complementary bands that are sewn to the inner and outer top edges of the pockets 4, 5, 6 and 7. The two bands are comprised of a nylon material, one of which has a fiber hook type surface while the other has an adhesive pile type surface and when pressed together they remain adhered to each other resulting in closure and thus securing the weights 4a, 4b, 5a, 6a and 7a in FIGS. 4 and 5 in their respective pockets. They facilitate easy fastening and unfastening. An example of such a closure is Velcro(R), but it should be understood that other fasteners such as zippers, laces, snaps, straps or buckles may also be employed. FIG. 5 illustrates a typical embodiment of a pocket 5 showing its closure 9 but in an opened position ready to receive its respective weight 5a.

Figure 3:
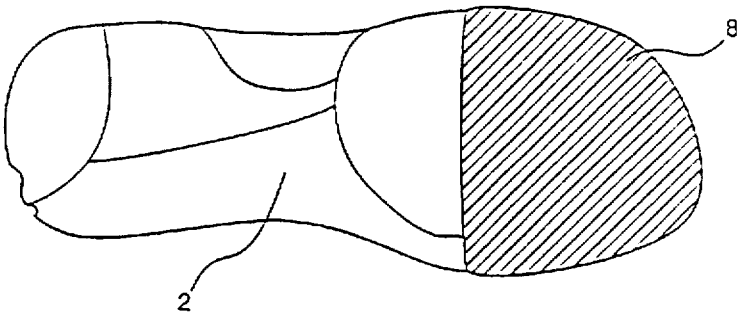
FIG. 3 is a bottom view that shows the under surface of the shoe with the sole that attaches the footwear garment to the toe section of the shoe.

An additional embodiment shown in FIG. 3 is a vinyl or rubber sole 8 which is sewed to the distal toe section of the footwear garment 3. It forms the only under surface of the garment and allows it to grip the toe portion of the shoe while the opposite end of the garment is stretched taut over the heel portion thus securing the garment to the shoe 2.

Another embodiment are the weights 4a, 4b, 5a, 6a and 7a in FIGS. 4 and 5 which are made of lead or other heavy material and are shaped to anatomically match the corresponding segment of the foot and shoe to which they are attached. Thus the toe weights 4a and 4b are contoured to match the convexity of the shoes toe section. The side weights, lateral and medial; 5a and 6a are also contoured to be slightly convex in order to correspond to the shape of the sides of the shoe to which they are attached. The heel weight 7a is contoured to be convex as well in order to correspond to the heel section of the shoe.

The distal end of the toe weights 4a and 4b are rounded to correspond to the distal toe section of the shoes. The proximal end towards the ankle is slanted fifteen degrees so that its medial end corresponds to the first metatarsal phalangeal joint of the big toe while the longer lateral end corresponds to the fifth metatarsal phalangeal joint of the little toe. This incline of the proximal end of the toe weight allows for unrestricted flexion of the metatarsal phalangeal joints while participating in a variety of physical activities including running and walking. The density, mass and dimensions for all of the weights will vary depending on the size, weight and conditioning of the user and the application intended. For adult use though; toe, heel and side weights 4a, 4b, 7a, 5a and 6a may start at one quarter of a pound or lower and go up to one or two pounds or in some instances even higher.

The weighted footwear garment may also serve as a training device for a number of competitive sports as well as performing arts activities and may even be used as a therapeutic device in treating patients with certain neurological disorders. Football, baseball, basketball players as well as dancers, hikers, back-packers and participants in martial arts, track and field as well as other physical activity events may find that their speed, strength and endurance are significantly improved following non-contact training with the weighted footwear garment. Removal of the weighted footwear garmen prior to the start of the competitive event could possibly enable the user to achieve his or her peak performance just at that moment when it is most desired.

Certain neuro-musculoskeletal disorders resulting in weakness of the lower limb can be improved with strengthening exercises that are best served under the direction of a physical therapist. An example would be a patient with weakness in just their dorsiflexors and toe extensors which are the muscles that pull the foot and toes up. In this instance the therapist would utilize only the toe weight in the exercise program and instruct the patient in regard to the frequency and number of repetitions to be done in a static seated or supine position to achieve maximum strengthening. An additional advantage of this invention is that the patient can be instructed and trained to use the weighted footwear garment functionally. The patient then can walk distances within in his or her own tolerance with the toe weight in place facilitating recovery of strength in the affected muscles.

Some neurological disorders result in impaired position sense and loss of balance plus poor coordination. Another application for the weighted footwear garment is to try and help stabilize certain gait and balance disorders. Patients with ataxia are sometimes able to ambulate more safely when their shoes are weighted down. In situations such as this the therapist utilizing the weighted footwear garment would be able to determine the most effective combination and position for the weights before recomnmending the exact amount and location to be permanently attached to patient's shoes by the orthotist.

Though, many specifications have been described they should not be construed as limiting the scope of this invention but merely as a means of illustrating some of the presently preferred embodiments of this invention. An example is whereby the contoured toe weight may be retained by a strap or clip-on attachment to the toe weight and then secured to the sole of the shoe or a weight device other than the weighted footwear garment.

Thus the scope of the invention should be determined by the appended claims and their legal equivalents rather than by the examples given.

I claim:

1. A removable two piece stretch fabric footwear garment for use as a weighted shoe attachment for running, power walking, exercise, training or therapy comprising two pieces, each forming opposite sides of a loop, one piece adopted to fit snugly over the toe end of a shoe, the other adopted to fit snugly over the heel end of a shoe at least one of the two pieces having medial and lateral side portions the heel portion having an upper opening to accommodate at least the ankle of a user and a lower opening to accommodate at least the heel of a shoe, the toe portion having an upper section made of stretch fabric and a lower section comprising a sole portion attached to the lower edge of the toe portion of said garment so as to fit tightly around the toe of a shoe, each of said toe, medial and lateral side and heel portions having pockets for carrying weights attached thereto and each of said pockets having closure for holding weights securely therein.

2. The stretch fabric footwear garment of claim 1 wherein said sole connected to the toe piece of said garment is made of a material selected from the group consisting of vinyl and rubber.

3. The stretch fabric footwear garment of claim 1 wherein said pockets contain weights.

4. The stretch fabric footwear garment of claim 1 wherein the toe pocket substantially covers said upper section of said toe portion both of which are made of stretch fabric.

5. The stretch fabric footwear garment of claim 1 wherein the medial and lateral side portions are part of the heel section and the pieces are attached at the ends of said medial and lateral side portions and toe portion.

6. The two piece stretch fabric footwear garment of claim 1 wherein the two pieces are attached to each other by means of buckles and straps.

7. The two piece footwear garment of claim 1 wherein the sole portion is attached only to the distal toe section of the garment whereby the major portion of the sole of the shoe to which the garment is attached remains exposed.

8. The garment of claim 7 wherein the sole portion is made of a material selected from the group consisting of vinyl and rubber.

9. The two piece footwear garment of claim 1 wherein all of the attached pockets for carrying weights are made of a stretch fabric.

10. The two piece garment of claim 1 where in said medial and lateral side portions contain attachment means for securely joining the toe and head portions via said medial and lateral side portions.

* * * * *